US010100448B2

(12) United States Patent
Dilo

(10) Patent No.: US 10,100,448 B2
(45) Date of Patent: Oct. 16, 2018

(54) NEEDLE MODULE FOR A NEEDLE BOARD OF A NEEDLING MACHINE

(71) Applicant: Oskar Dilo Maschinenfabrik KG, Eberbach (DE)

(72) Inventor: Johann Philipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 21 days.

(21) Appl. No.: 15/342,691

(22) Filed: Nov. 3, 2016

(65) Prior Publication Data

US 2017/0130380 A1 May 11, 2017

(30) Foreign Application Priority Data

Nov. 5, 2015 (EP) ..... 15193258

(51) Int. Cl.
*D04H 18/02* (2012.01)

(52) U.S. Cl.
CPC ..... *D04H 18/02* (2013.01)

(58) Field of Classification Search
CPC ..... D05C 11/04; D05C 15/10; D05C 1/065; D04H 18/00; D04H 1/46; D04H 3/102; D04H 3/105; D04H 18/02
USPC ..... 28/115; 112/80.45, 80.6, 80.4
See application file for complete search history.

(56) References Cited

U.S. PATENT DOCUMENTS 2,896,303 A * 7/1959 Morrill ..... D04H 18/02 28/115
3,877,120 A * 4/1975 Okamoto ..... D04H 18/02 28/115
4,574,716 A * 3/1986 Czelusniak, Jr. ..... D05C 15/20 112/80.41
5,295,450 A * 3/1994 Neely ..... D05C 15/22 112/80.45
5,860,373 A * 1/1999 Beyer ..... D05C 15/10 112/80.45
6,116,173 A * 9/2000 Beyer ..... D05C 15/20 112/80.45
2006/0150876 A1* 7/2006 Green ..... D05C 15/16 112/80.4
2010/0162543 A1* 7/2010 Dilo ..... D04H 18/00 28/115

(Continued)

FOREIGN PATENT DOCUMENTS

EP 2138616 A1 12/2009
EP 2918719 A1 9/2015

(Continued)

OTHER PUBLICATIONS

English language machine translation of JPH11-350327, doc pub. date Dec. 1999; 13 pages.*

*Primary Examiner* — Amy Vanatta
(74) *Attorney, Agent, or Firm* — Jansson Munger McKinley & Kirby Ltd.

(57) ABSTRACT

The needle module for mounting in receptacles of a needle board of a needling machine comprises a plurality of module segments. Each module segment comprises a segment head and at least one needle, and the segment head is equipped with the at least one needle. The needle module also comprises a guide element extending in a longitudinal direction of the needle module. In an adjustment state of the needle module, the module segments are connected to the guide element, and at least one module segment is movable along the guide element.

13 Claims, 3 Drawing Sheets

(56) References Cited

U.S. PATENT DOCUMENTS

| | | | | |
|---|---|---|---|---|
| 2011/0041303 | A1* | 2/2011 | Haussler | D04H 18/02 28/115 |
| 2014/0261121 | A1* | 9/2014 | Woodall | D05C 15/10 112/80.45 |
| 2015/0259836 | A1* | 9/2015 | Dilo | D04H 1/46 28/111 |

FOREIGN PATENT DOCUMENTS

| | | | | |
|---|---|---|---|---|
| GB | 399104 | A * | 9/1933 | D04H 18/02 |
| JP | H11350327 | A | 12/1999 | |

* cited by examiner

NEEDLE MODULE FOR A NEEDLE BOARD OF A NEEDLING MACHINE

CROSS REFERENCE TO RELATED APPLICATION

This application claims priority based on European patent application EP 15 193 258.9 filed Nov. 5, 2015. The entire disclosure and contents of this application is incorporated by reference into the present application.

FIELD

The invention relates to a needle module and, more specifically, to a needle module for a needle board of a needling machine.

BACKGROUND

Needling machines are generally well known in the prior art and are described in, for example, *Vliesstoffe* [*Nonwovens*] by Lünenschloss and Albrecht, Georg-Thieme-Verlag, Stuttgart, 1982, pp. 122-129.

In needling machines, a nonwoven is usually supplied to the inlet of the machine and conveyed to the needling zone. A needle bar, to which a needle board is fastened, is arranged in the area of the needling zone. The needle board is equipped with needles for consolidating the nonwoven. In this area, the nonwoven to be needled is guided between a stripper plate and a stitching plate. The needles consolidate the nonwoven as they are punched into the nonwoven and pulled back out again at high frequency. As this is being done, the needles pass through openings in the stripper plate and stitching plate. The resulting product is a consolidated nonwoven. The expert is familiar with the various types of needling machines, including double-needle machines, in which two needle bars are used for needling, one from above, the other from below, and needling machines in which the needle bars are moved along in the direction of the nonwoven during the consolidation process.

U.S. Patent Application No. 2010/0162543 discloses a needle board for needling machines which comprises a plurality of needle modules, each of which comprises a carrier plate, equipped with a plurality of needles. The individual needles are mounted in the carrier plate of the needle module by injection-molding or casting. The needle modules are set into slots in a base plate of the needle board. Through the use of needle modules in a needle board, it has become possible to refit needle boards quickly and easily and to prolong the life of the needle boards, because there is no longer any need for the individual bores in the needle board into which the individual needles fit, and the wear to which these bores are subject during the replacement or exchange of the individual needles is no longer a concern. The arrangement of the individual needle modules in the needle board and the arrangement of the individual needles with respect to each other within a needle module, however, are fixed and cannot be varied. If the needling of the nonwoven is now to be carried out with a different pattern or if an adaptation of the needle arrangement or spacing of the needles is desired to homogenize the stitching pattern or to compensate for defects, individualized needle modules and needle boards must be kept on hand for all possible arrangements which can come into question, and, when necessary, the modules and boards must then be exchanged at the cost of considerable effort.

It is an object of the present invention to provide a needle module for a needle board of a needling machine in which the spacing and the arrangement of the individual needles with respect to each other are variable.

SUMMARY

According to an aspect of the invention, a needle module for mounting in receptacles of a needle board of a needling machine comprises a plurality of module segments, wherein each module segment comprises a segment head and at least one needle, and wherein the segment head is equipped with the at least one needle. The needle module also comprises a guide element extending in a longitudinal direction of the needle module, wherein, in an adjustment state of the needle module, the module segments are connected to the guide element, and at least one module segment is movable along the guide element.

In this way it is possible to provide module segments with one, two, or several needles, to shift the individual module segments along the guide element in almost any way desired, and to adjust the spacing of the various module segments in almost any way desired. This is preferable. As a result, the individual needle modules can be adapted individually, independently of each other, in almost any way desired to many situations of widely varying types, and the stitching pattern can be modified as necessary without the need to make any significant changes to the needle boards or to the components of the needle module. Thus, it is preferable that this needle module can be used, for example, to produce predefined stitching patterns, to correct defects in a previously needled nonwoven, or generally to produce a homogeneous stitching pattern. The advantages derived from this are many and are primarily economic, because there is no need to fabricate individual needle boards or needle modules to suit each individual set of circumstances, and preset needle modules can be put into service quickly.

The segment head of each module segment preferably comprises a first receptacle, which holds a section of the guide element. Thus, the individual module segments preferably can be connected movably and compactly to the guide element. Alternatively, it is conceivable that the guide element could be provided with a receptacle to accept corresponding sections or mating parts of the segment heads of the module segments.

To preferably implement the movable connection between the module segments and the guide element in an especially advantageous fashion, to make possible the simple mounting of the module segments on the guide element, and to make it easy to set the spacing between the module segments, the first receptacle, in a first embodiment, is formed as a bore passing through the segment head or, in a second embodiment, as a groove in the segment head. The expert will be familiar with other suitable embodiments of the first receptacle for producing a suitable connection between the guide element and the segment head.

It is especially preferable for at least one module segment to comprise a plurality of needles. Preferably the segment head can comprise predefined breaking points between each needle and its neighbor. As a result, individual module segments of the desired lengths or with the desired number of needles can be obtained especially easily from a strip of module segments. In particular, a uniform production process for module segment strips of uniform length can lead to economic advantages, above all with respect to tooling costs which is highly preferred. The individual module segments can in this case be separated from the module segment strip after the module segment strips have been produced, as will become clear from the description of the embodiments illustrated by way of example in the drawings.

In a preferred embodiment, the guide element comprises a substantially circular or oval cross section. These cross-sectional forms are especially well adapted to the movable connection of the module segments to the guide element, especially with respect to a shifting of the module segments along the guide element.

The spacing of the plurality of module segments with respect to each other is preferably made permanent by putting the needle module into a "fixation state." This guarantees that the distances between the individual module segments, which have been specified previously on the basis of the existing boundary conditions, cannot change as a result of the vibrations, for example, which occur during the operation of the needling machine.

In one preferred embodiment, the guide element is configured as a wire, as a result of which the guide element can be realized at very low cost. Additional advantages can be derived from a wire fabricated of aluminum, for example, or of copper, because of the ease of shaping and processing these materials.

It is especially preferable for the fixation of the spacing between the module segments to be accomplished by a positive connection. This positive connection can be achieved by deformation of sections of the guide element next to the segment heads. Especially in the case of aluminum or copper wire, this represents an especially simple way to fix the distances between the individual module segments, and no additional locking elements are required. As a result, both weight and space can be saved. Such deformation, furthermore, ensures the safe and reliable operation of the needling machine, because the position of the individual module segments cannot change during operation.

A needle board for a needling machine preferably comprises a plurality of second receptacles, into which a plurality of the needle modules described above are inserted. Thus, a needle board is provided which can be equipped with the needle modules described above quickly and easily, and the needle modules can also be replaced quickly and easily all which is highly preferred. In addition, the stitching pattern of the needling machine can thus be varied without the need to install a new needle board.

In an alternative preferred embodiment of the needle module, the guide element is configured as a threaded rod with an external thread. In this case, the first receptacle of the segment head is configured with an internal thread, so that the external thread of the threaded rod and the internal thread of the segment head can engage with each other. This embodiment is especially well adapted to the reversible adjustment of the spacing of the module segments with respect to each other, so that the guide element can be used multiple times, and incorrect adjustments of the spacings can be easily corrected or readjusted. In addition, the use of a threaded rod as a guide element is especially well adapted to the adjustment of the module segment arrangement or needle arrangement in an automated presetting machine.

In cases where the guide element is configured as a threaded rod, the fixation state of the needle modules, in which the spacing of the plurality of module segments with respect to each other is fixed, is preferably not realized in the needle board of a needling machine until after all of the needle modules have been inserted in a plurality of second receptacles. The fixation of the spacing between the module segments is carried out by a positive connection based on the contact of the segment heads against the wall areas of the plurality of second receptacles in the needle board.

In this highly preferred way, a needle board can be equipped or reequipped quickly and easily with needle modules of this kind. In addition, the spacing between the individual module segments on the threaded rod is fixed without the need for additional structure or the need to machine the guide element irreversibly.

BRIEF DESCRIPTION OF THE DRAWINGS

The invention is explained in greater detail below with reference to the embodiments illustrated in the drawings.

DETAILED DESCRIPTION

Figure 1:
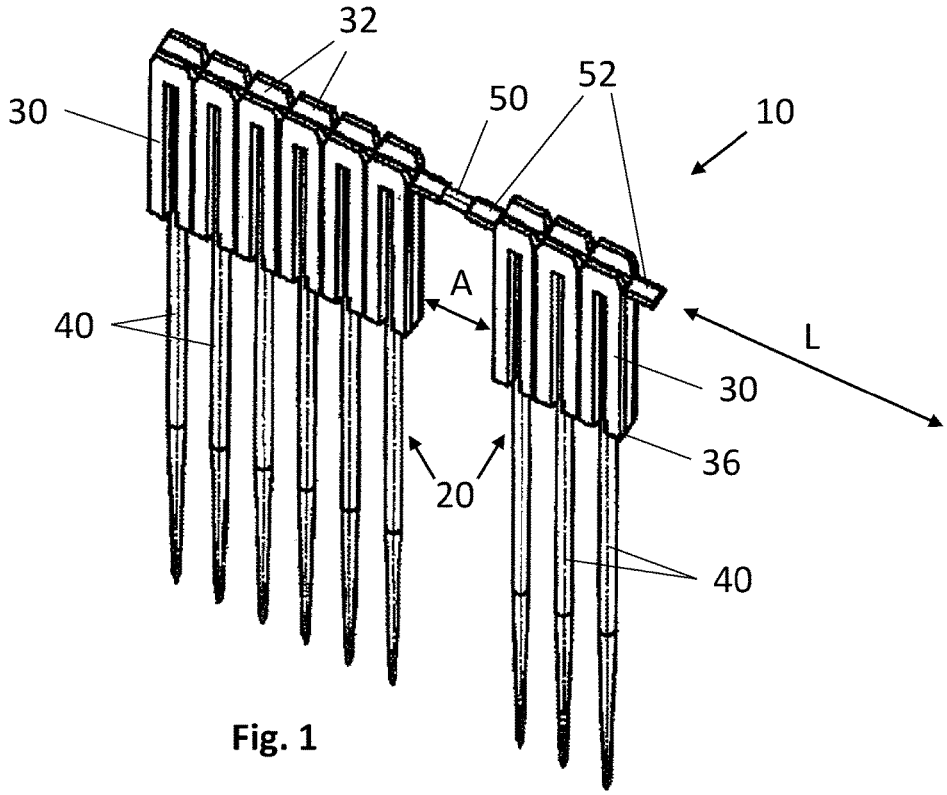
FIG. 1 is a perspective view of one embodiment of the needle module according to the invention in the fixation state, wherein the guide element is configured as a wire.

FIGS. 1-5 show embodiments of the needle module 10 according to the invention. As will be explained with reference to FIGS. 4 and 5, this needle module 10 can be inserted into second receptacles 4 of a needle board 1. Needle module 10 comprises a plurality of module segments 20 and a guide element 50. Each module segment 20 comprises a segment head 30 and at least one needle 40. Guide element 50 extends substantially in a longitudinal direction of needle module 10, as indicated in FIG. 1 by the arrow L. In the "adjustment state" (not shown) of needle module 10, module segments 20 are connected to guide element 50, and at least one module segment 20 is movable along guide element 50. In the embodiment shown, module segments 20 are shifted along guide element 50 to obtain the desired spacing and arrangement. The module segment spacing A is the distance between two adjacent module segments.

As can be seen in FIG. 1, each segment head 30 comprises a first receptacle 32, which accepts a section of guide element 50. In the embodiment shown, first receptacle 32 is configured as a groove, which has a substantially circular cross section, and in which guide element 50 is held, wherein the cross section, furthermore, widens conically toward the top. The narrow point between the circular cross-sectional part and the conically widening, upward-facing cross-sectional part is to be made smaller than the diameter of guide element 50. In this way it is possible either to press guide element 50 down from above past this narrow point into segment heads 30 or to introduce it laterally, wherein, after module segments 20 have been connected to guide element 50, they are free to move in the longitudinal direction L of needle module 10 but cannot work themselves free from guide element 50 in the direction transverse to the longitudinal direction L of needle module 10. Alternatively, it is conceivable that first receptacle 32 could be configured as a bore passing through an upper section of segment head 30, through which guide element 50 can pass, or that first receptacle 32 is configured as a groove through which a guide element 50 with a rectangular cross section, e.g., a bar, can pass. Ideally, the contour of the cross section of the part of first receptacle 32 which accepts guide element 50 is adapted to the contour of the cross section of guide element 50 in such a way as to produce a secure connection and at the same time to ensure the mobility of segment head 30 on guide element 50.

Guide element 50 can consist of a wire, as shown by way of example, or of some other rod-shaped element which is as thin as possible. Wire can be purchased cheaply and can be easily adapted to the desired length of needle module 10. The wire can be made of aluminum or copper, for example. In FIG. 1, needle module 10 is shown in the fixation state. Here sections 52 of guide element 50 adjoining segment heads 30 of module segments 20 have been plastically deformed. As a result of the deformation of sections 52 of guide element adjacent to segment heads 30, module segments 20 are positively locked to guide element 50. The position and thus the spacing of module segments 20 with respect to each other are therefore fixed. In the adjustment state, in contrast to the fixation state, needle module 10 has no deformed sections 52, as a result of which individual module segments 20 can be moved freely along guide element 50.

Segment head 30 is usually cast or injection-molded onto needles 40, which makes it easy to produce module segments 20. Segment head 30 is formed out of plastic, preferably of a rigid plastic, which can be reinforced with glass fibers. Alternatively, it is also possible that needles 40 could be introduced or pressed into appropriate openings in prefabricated segment heads 30. To eliminate completely the possibility that needles 40 might move in a longitudinal direction of needles 40 within the openings, needles 40 can have mushroomed or bent-over heads. The shafts of needles 40 can also be roughened. Additional joining or production possibilities for module segments 20 of this type can be derived by the expert from this disclosure.

In the production of module segments 20, furthermore, care must be taken to ensure that, between the head of needle 40, i.e., the end opposite the tip of needle 40, and the uppermost edge of segment head 30, there is sufficient room for the formation of first receptacle 32. This distance between the head of needle 40 and the upper edge of segment head 30 is preferably at least 1-5 mm.

Figure 2:
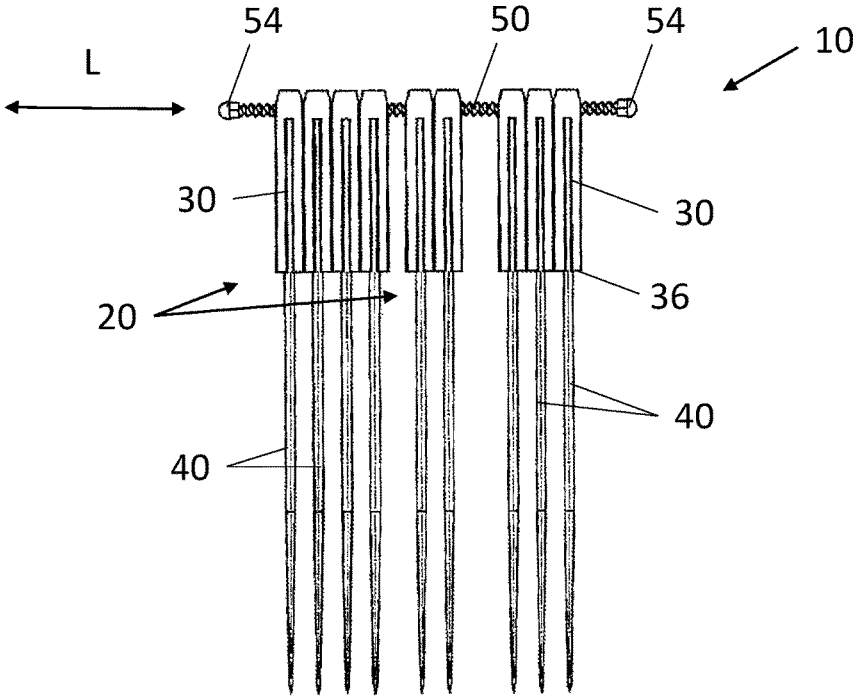
FIG. 2 is a front view of another embodiment of the needle module according to the invention in the adjustment state, wherein the guide element is configured as a threaded rod.

FIG. 2 shows another embodiment of a needle module 10 according to the invention, in which guide element 50 is configured as a threaded rod. The rod comprises an external thread, which engages with an internal thread formed in first receptacle 32 of segment heads 30. In the adjustment state of needle module 10 shown, individual module segments 20 can be turned freely and thus moved along threaded rod 50. The adjustment of the spacings A of the individual module segments from each other is preferably carried out in a presetting device, as will be explained at the end of the description of the drawings. Threaded rod 50 preferably comprises an end cap 54 of plastic at each end. End caps 54 serve to mount rod 50 in the presetting device and also to mount needle module 10 in a needle board 1. Alternatively, the corresponding end sections can be configured as integral parts of threaded rod 50, e.g., as rotationally symmetric shoulders without threads.

If guide element 50 is configured as a threaded rod, an internal thread must be provided in first receptacle 32 of each segment head 30. First receptacle 32 can be configured as a bore, but again it should comprise a substantially circular cross section which widens out conically toward the top. In this case, it must be ensured that the circular cross-sectional part of first receptacle 32 covers a sufficiently large part of the circumference of the threaded rod, so that the external thread of the threaded rod and the internal thread of first receptacle 32 can engage cleanly with each other. The upward-facing, conical opening of the cross section in the form of a groove does not interfere with interaction of the threads, nor does it prevent module segments 20 from moving along guide element 50. In cases where a threaded rod is being used as guide element 50, furthermore, the fixation of the module segment spacings A is preferably achieved by a positive connection between segment heads 30 and needle board 1, as will described further below with reference to FIG. 5.

Figure 3:
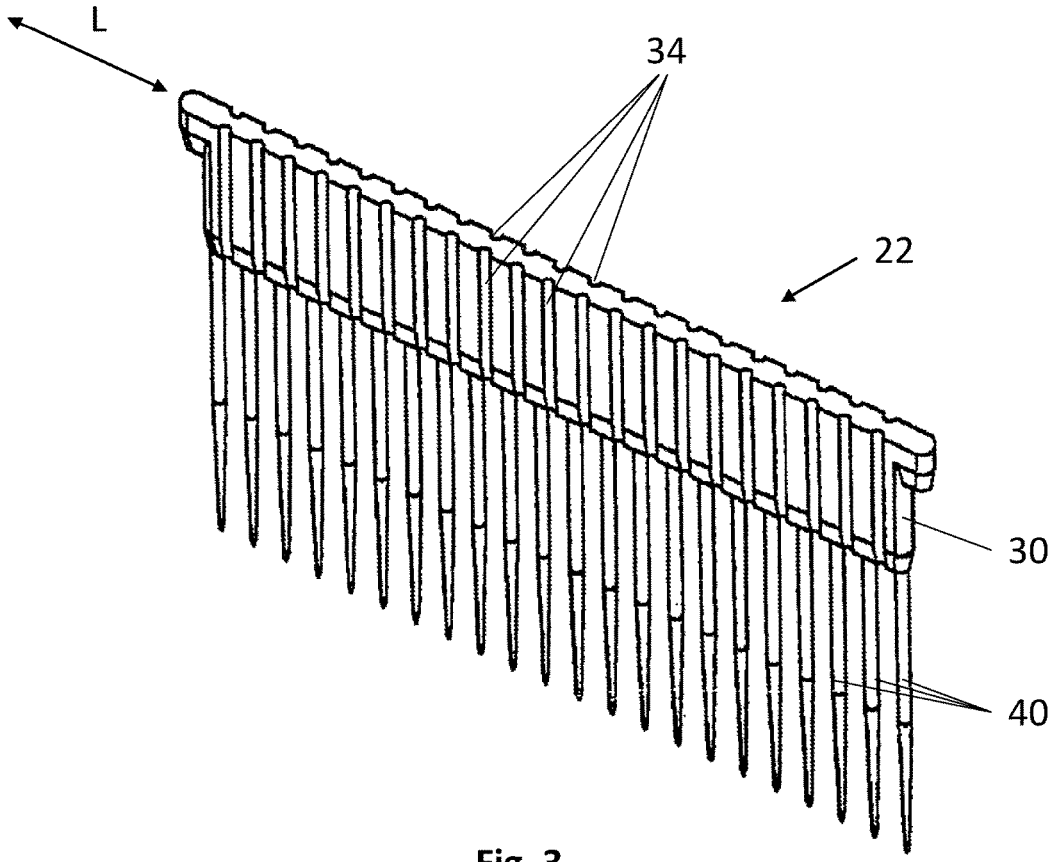
FIG. 3 is a perspective view of a module segment strip with predefined breaking points.

FIG. 3 shows a perspective view of a module segment strip 22 with predetermined breaking points 34. More precisely, a module segment strip 22 is shown here from which individual module segments 20 with any desired number of needles 40 can be obtained by breaking module segment strip 22 along predetermined breaking points 34. Guide element 50 and first receptacle 32 in segment head 30 are not shown in this figure for the sake of clarity but are present according to the invention, as can be seen in the other figures.

Predetermined breaking points 34 in the example shown here are configured as vertical grooves in segment head 30, parallel to the longitudinal axes of the needles. Each predetermined breaking point is preferably introduced between two adjacent needles 40, one on each side, in segment head 30. By breaking the strip, module segments 20 of various lengths, i.e., with any desired number of needles 40, can be obtained. The formation of predetermined breaking points 34 by grooving both sides of segment head 30 turns out to be especially well adapted to the purpose, but the expert is familiar with other possible ways in which suitable predetermined breaking points can be formed. Standard methods for forming predetermined breaking points include, for example, any manner of reducing the thickness of the material or other ways of weakening the material at the predetermined points, e.g., by perforation. Module segment strips 22 can be fabricated in any desired length, including as more-or-less endless strips.

Module segment strips 22 turn out to be highly advantageous with respect to the process of producing module segments 20. The process for producing module segments 20 can be highly standardized when module segment strips 22 of uniform length are produced, wherein segment head 30 of module segment strip 22 comprises the previously described predetermined breaking points 34. In this way, module segments 20 can be separated from module segment strip 22 without the need for a separate production process or for an inventory of tooling for individual sizes of module segments 20. This is advantageous especially under consideration of the tooling costs for injection molds (dies), for example.

In general, module segments 20 with one needle 40 or module segments 20 with several needles 40 can also be produced in many other ways.

Figure 4:
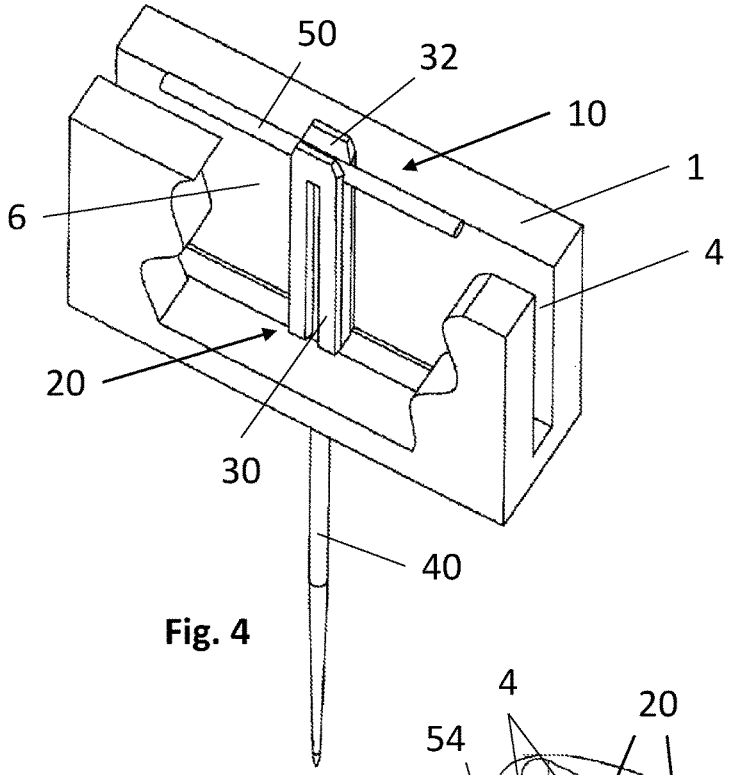
FIG. 4 is a perspective view of a section of a needle board for a needling machine with an embodiment of the needle module according to the invention.
Figure 5:
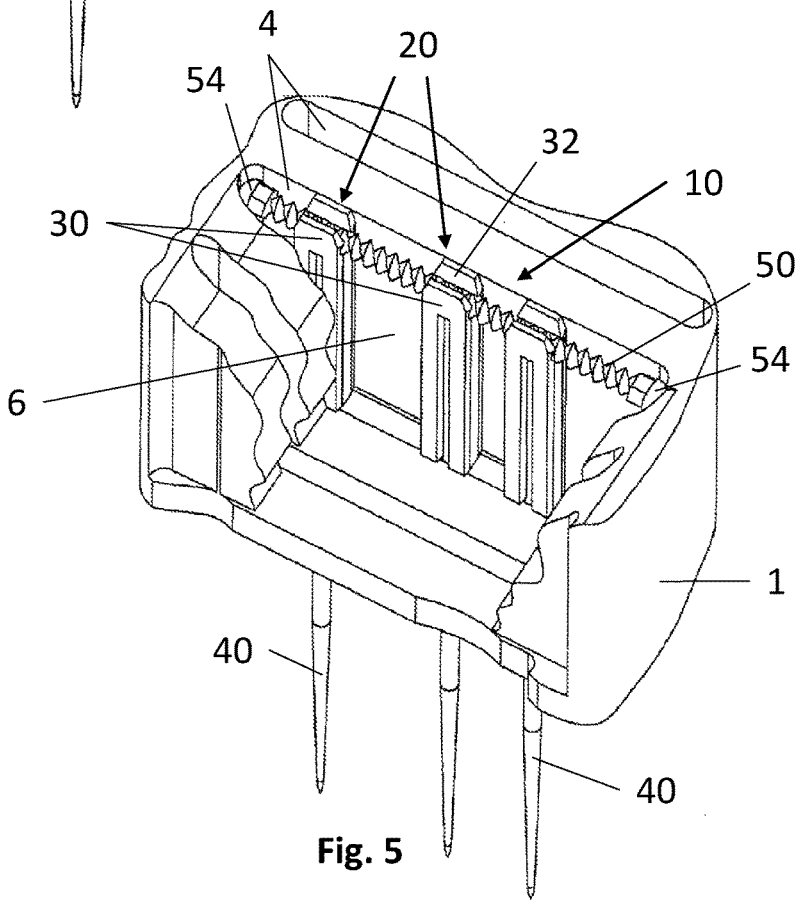
FIG. 5 is a perspective view of a section of a needle board of a needling machine with another embodiment of the needle module according to the invention.

FIGS. 4 and 5 show schematic diagrams of needle modules 10 similar to that of FIGS. 1 and 2 inserted in second receptacles 4 of a needle board 1. Needle board 1 consists substantially of a base plate, which can be made of aluminum or magnesium, and which comprises a plurality of second receptacles 4 to receive needle modules 10. Second receptacles 4 are preferably formed as slots in needle board 1, which extend in the longitudinal direction L of needle modules 10. Slots or second receptacles 4 are for their own part arranged in needle board 1 in correspondence with the given requirements. Thus, it is possible for slots and needle modules 10 inserted into them to extend in the direction in which the nonwoven is conveyed, in the direction transverse to the nonwoven conveying direction, or at an angle to the nonwoven conveying direction. Needle module 10 according to the invention can be used in many different needle boards. Each of FIGS. 4 and 5 shows only part of a needle board 1, wherein, for the sake of clarity, only one needle module 10 has been inserted into a second receptacle 4, and the adjacent side walls of needle board 1 are shown cut away to provide a better view.

FIG. 4 shows a needle module 10 with only one module segment 20, but obviously there will usually be several module segments 20 per needle module 10. Lower support surface of each segment head 30 lies on a bottom shoulder of second receptacle 4 of needle board 1. As a result, segment head 30, and thus, needle module 10 cannot slide downward when needle board 1 makes its vertical up-and-down movements. In the embodiment shown, guide element 50 is again configured as a wire or some other rod-shaped element of round cross section (similar to FIG. 1). In contrast to FIG. 1, guide element 50 shown here has no deformed sections 52 to establish a positive fixation of the positions of module segments 20. Here the module segments 20 are held in their positions by friction, namely, as a result of the non-positive connection between segment head 30 and second receptacle 4 of needle board 1 or by the friction created by the clamping of segment head 30 between needle board 1 and the needle bar. In both cases, the friction surface of needle board 1 or of the needle bar can be provided with an additional layer with a high coefficient of friction such as sandpaper to increase the strength of the frictional force.

Additionally or alternatively, spacers or sleeves of any desired length can also be threaded onto guide element 5 between module segments 20.

Obviously, the previously described embodiment with plastically deformed sections of guide element 50 adjacent to segment heads 30 could also be used in FIG. 4. The fixation state of needle module 10 can therefore be present even before needle module 10 is inserted into needle board 1 (i.e., in cases where there is a positive fixation of module segments 20 on guide element 50), or it can be present only after the insertion of needle module 10 into needle board 1 (positive and/or non-positive fixation in conjunction with needle board 1 and/or needle bar). The fixation of the position of needle module 10 in needle board 1 in a direction transverse to the longitudinal direction L of needle modules 10 is achieved preferably by a positive connection between the lateral surfaces of segment heads 30 and wall areas 6 of second receptacles 4. The fixation of the position of needle module 10 in needle board 1 in longitudinal direction L of needle modules 10 is achieved preferably by pressing the ends of guide elements 50 into second receptacles 4. In general, however, it is also conceivable that needle modules 10 could be accommodated movably in second receptacles 4 in longitudinal direction L and that fixation could then be carried out later, e.g., by additional locking devices.

FIG. 5 shows a needle module 10 similar to that of FIG. 2 inserted into a second receptacle 4 of a needle board 1. In the case shown here, guide element 50 is again configured as a threaded rod, which comprises two end caps 54, one at each end. Needle module 10 is pressed or hammered, for example, into second receptacle 4, so that end caps 54 rest against the edge area of second receptacle 4, and thus, fix the position of needle module 10 positively in longitudinal direction L of needle module 10. Here, too, preferably the lower support surfaces of segment heads 30 rest on the base of the second receptacles 4 in order to additionally prevent needle module 10 from shifting downward during the vertical up-and-down movements of needle board.

In the embodiment of FIG. 5, but also in the embodiments described with reference to FIG. 4, it is not mandatory that a lower support surface of segment heads 30 rest on a support, because a sufficient securing or fixation of needle modules 10—depending on the up-and-down speeds of needle board 1—can also be achieved by the clamping of needle module 10 into second receptacle 4. Other methods could also be provided for this purpose. For example, it is conceivable that segment heads 30 could be provided with lateral shoulders, possibly extending all the way around the periphery, which are arranged in an upper area of segment heads 30 and which come to rest on a corresponding shoulder in needle board 1 or in receptacles 4 of needle board. It is also conceivable that only the two end sections of guide element 50, e.g., end caps 54, could rest on corresponding shoulders in the needle board.

In the embodiment shown in FIG. 5, the fixation state of needle module 10 is obtained by a positive connection of segment heads 30 with a side wall 6 of second receptacle 4 of needle board 1. Before needle module 10 is inserted into needle board 1, needle module 10 is in the adjustment state, in which individual module segment 20 can be rotated and thus moved along the threaded rod to any extent desired and thus positioned with respect to the others. After the insertion of needle modules 10 into receptacles 4, a turning of module segments 20 is prevented by the contact of at least certain sections of the lateral surfaces of the segment heads 30 against side wall 6 of receptacle 4, and the position of individual module segments 20 is therefore fixed by a positive connection. The setting of module segment spacings A and additional possibilities for fixing needle modules 10 and module segments 20 in needle board 1 are described in the following.

In principle, the upper edge of module segments 20, i.e., of segment heads 30, can project above a surface of needle board 1, so that a clamping action is produced between the module segments and the needle bar, to which needle board 1 is attached (see FIG. 4). In this case, second receptacles 4 in needle board 1 and segment heads 30 of needle modules 10 could, for example, taper conically downward, or support surfaces of segment heads 30 could rest correspondingly on shoulders of second receptacles 4, so that module segments 20 cannot be pushed downward all the way through second receptacles 4. In principle, individual module segments 20 are already being held in their positions by this clamping action, and further fixation of the spacing between module segments 20 is not absolutely necessary. Because of the high reciprocating frequency and acceleration during the needling process, however, it is to be feared that, in the case of a purely frictional locking as described above, the vibrations which occur could lead to the displacement of module segments 20 in receptacles 4 and thus to a change in the distances between individual needles 40. The positions of module segments 20 on guide elements 50 is therefore preferably secured additionally, preferably by a positive connection. This positive connection can be achieved, for example, by the plastic deformation of sections 52 of guide element 50 adjacent to segment heads 30 or by the contact of lateral surfaces of segment heads 30 against side walls 6 of second receptacles 4 in combination with a thread. It is also possible that the positive connection could be achieved by additional elements.

For example, additional elements such as pinch bushings can be attached to the wire and plastically deformed to fix the position of adjacent segment heads 30. When a threaded rod is used as guide element 50, locknuts can be provided to fix the position of module segments 20 on guide element 50. However, module segment spacing A is ideally established without additional elements.

The adjustment of module segment spacings A on guide elements 50 can be carried out either manually or in a presetting device. There are in turn various ways of realizing each of these types of setting procedures. It is left to the expert to choose whichever one he prefers.

For example, in the case of the manual setting of the module segment spacings A in the embodiment of FIG. 1 or FIG. 4, it is possible to push module segments 20 in any way desired onto guide element 50 (e.g., a wire) and manually to use a pliers and/or hammer blows to plastically deform sections 52 of guide element 50 adjacent to segment heads 30.

When a threaded rod is used as guide element 50 (FIGS. 2 and 5), module segments 20 can, when in the adjustment state, be rotated to any desired position along the threaded rod.

If the intention is to use a presetting device for the embodiments according to FIG. 1 or FIG. 4, this can be configured, for example, in such a way that needle modules 10 are inserted either into a receptacle of the presetting device or into receptacles 4 of needle board 1. A conical tip of a setting tool is inserted between segment heads 30 with a substantially vertical advancing movement, and module segments 20 are moved along guide element 50 until the specified position or arrangement is obtained. A presetting device can, accordingly, comprise several conical tips on the setting tool for setting the positions of module segments 20 of several needle modules 10.

When a threaded rod is used as guide element 50 (embodiment according to FIG. 2 or 5), it is possible, for example, for the positions of the module segments to be set preferably outside the needle board in a presetting device. For example, end caps 54 or other appropriately designed end sections of the threaded rod can be clamped in a chuck of the presetting device, wherein the chuck is drivable and can thus be used to rotate the threaded rod around its longitudinal axis. Module segments 20 connected to the threaded rod are rotated concomitantly as a result of the frictional connection between the internal threads of segment heads 30 and the external thread of the threaded rod. If an appropriate element (e.g., a pin or stop) prevents them from turning, module segments 20 will therefore travel axially along the threaded rod until the desired position is reached. The spacing A between the module segments can be controlled in this way or programmed according to the desired specifications.

Alternatively, it is conceivable that the ends of the threaded rods could be provided with appropriate contours or openings, in which a screwdriver or other tool can engage, and that the needle board 1 could be provided with openings aligned with the longitudinal axis of the threaded rod so that the ends of the threaded rod are accessible even after the rods have been inserted. By inserting a screwdriver or tool, module segments 20 can thus be shifted as desired collectively. Additional embodiments of presetting devices or tools adapted to the purpose of setting module segment spacing A and of fixing module segments 20 on guide elements 50 will be evident to the expert on the basis of the disclosure contained herein.

As previously mentioned briefly above, individual needle modules 10 can also be arranged movably in receptacles 4 of needle board 1 and fastened at the desired points by fastening mechanisms adapted to the purpose, possibly with the help of spacers.

Several guide elements 50 per needle module 10 and thus also a correspondingly larger number of first receptacles 32 per segment head 30 can also be present.

According to all of the embodiments, the setting of the spacing between individual module segments 20 of a needle module 10 is usually carried out on a free needle module 10, i.e., a module not yet inserted into needle board 1. Depending on the embodiment, however, the spacing between individual module segments 20 can also be set, in principle, even after needle module 10 has been inserted into needle board 1 or even after needle board 1 equipped with needle module 10 has already been attached to needle bar. The latter option is conceivable in particular in the case of the embodiment according to FIG. 4.

The fixation state of needle module 10 can accordingly be achieved at different points in time. The fixation of individual module segments 20 can be accomplished while needle module 10 is still separate (see FIG. 1, for example), but it can also be achieved after needle module 10 has been introduced into second receptacle 4 of needle board 1 (see FIG. 5, for example), or even after needle board 1 has been attached to needle bar (see comments on the modifications of the embodiment according to FIG. 4).

A wide variety of materials are available for the various parts discussed and illustrated herein. While the principles of this device have been described in connection with specific embodiments, it should be understood clearly that these descriptions are made only by way of example and are not intended to limit the scope of the device.

I claim:

1. A needle board kit including:

a needle board for a needling machine, the needle board having a plurality of receptacles; and a plurality of needle modules, wherein each of the plurality of needle modules is a separate unit which can be inserted in a respective receptacle of the needle board wherein at least one of the plurality of needle modules comprises:

a plurality of module segments, each module segment including a segment head equipped with at least one needle; and a guide element, extending in a longitudinal direction of the needle module, the needle module having, at least prior to insertion into the receptacle of the needle board, an adjustment state, wherein in the adjustment state, the module segments are connected to the guide element and at least one module segment is movable along the guide element.

2. The needle board kit of claim 1 wherein the segment head of each module segment comprises a guide receptacle which accepts a section of the guide element.

3. The needle board kit of claim 2 wherein the guide receptacle is configured as a bore passing through the segment head.

4. The needle board kit of claim 2 wherein the guide receptacle is configured as a groove in the segment head.

5. The needle board kit of claim 1 wherein at least one module segment comprises a plurality of needles.

6. The needle board kit of claim 1 wherein the guide element comprises a substantially circular or oval cross section.

7. The needle board kit of claim 1 wherein, in a fixation state of the needle module, a spacing of the plurality of module segments with respect to each other is fixed.

8. The needle board kit of claim 1 wherein the guide element is configured as a wire.

9. The needle board kit of claim 8 wherein fixation of the spacing between the module segments is achieved by a positive connection.

10. The needle board kit of claim 9 wherein the positive connection is achieved by deformation of sections of the guide element adjacent to the segment heads.

11. The needle board kit of claim 1 wherein the guide element is configured as a threaded rod with an external thread.

12. The needle board kit of claim 11 wherein a guide receptacle of the segment head is configured with an internal thread and the external thread of the threaded rod and the internal thread of the segment head engage with each other.

13. The needle board kit of claim 7 wherein the needle modules are inserted in the receptacles, and the fixation of the spacing between the module segments is achieved by a positive connection, wherein the positive connection is achieved by the contact of the segment heads against wall areas of the plurality of receptacles.

* * * * *